US008028995B2

(12) United States Patent
Hoffer

(10) Patent No.: US 8,028,995 B2
(45) Date of Patent: Oct. 4, 2011

(54) ELECTRO-MECHANICAL BEER PONG TABLE AND METHOD OF USE

(76) Inventor: Chad Hazen Hoffer, Carson City, NV (US)

( * ) Notice: Subject to any disclaimer, the term of this patent is extended or adjusted under 35 U.S.C. 154(b) by 7 days.

(21) Appl. No.: 12/731,035

(22) Filed: Mar. 24, 2010

(65) Prior Publication Data

US 2010/0244384 A1 Sep. 30, 2010

Related U.S. Application Data

(60) Provisional application No. 61/163,021, filed on Mar. 24, 2009.

(51) Int. Cl.
*A63B 67/00* (2006.01)
*A63B 63/00* (2006.01)
*A63F 7/00* (2006.01)

(52) U.S. Cl. ..... 273/342; 273/400; 473/496

(58) Field of Classification Search ..... 273/309, 273/340–342, 400–402; 473/496; 108/20, 108/25, 26, 59, 92, 94, 102–105; D21/338, D21/341

See application file for complete search history.

(56) References Cited

U.S. PATENT DOCUMENTS

| | | | | |
|---|---|---|---|---|
| 4,779,365 | A * | 10/1988 | Theeten | 38/135 |
| 6,729,982 | B1 * | 5/2004 | Appelbaum et al. | 473/496 |
| 7,325,807 | B1 * | 2/2008 | Eason | 273/342 |
| 2006/0226606 | A1 * | 10/2006 | Finley et al. | 273/342 |
| 2010/0148434 | A1 * | 6/2010 | Brustmeyer | 273/108 |
| 2010/0244384 | A1 * | 9/2010 | Hoffer | 273/342 |

* cited by examiner

*Primary Examiner* — Raleigh W. Chiu
(74) *Attorney, Agent, or Firm* — John D. Long, Esq; Long & Chybik

(57) ABSTRACT

One possible embodiment could be an electro-mechanical beer pong game table and a method of operating same. The game table could comprise a playing surface with a centerline axis; a plurality of movable platforms, the movable platforms being located over the playing surface; each movable platform reversibly and securely receiving a set of upright cups, each cup capable of containing beer and receiving a bear pong ball as played in the game of beer pong; one or more actuators that impart at least one motion to the movable platform relative to the playing surface; and an controller connected to the one or more actuators and controlling the at least one motion provided by the actuators wherein at least one movable platform is placed into motion relative to the playing surface and beer pong ball is thrown in the direction the moving movable platform.

20 Claims, 2 Drawing Sheets

ELECTRO-MECHANICAL BEER PONG TABLE AND METHOD OF USE

CROSS-REFERENCES TO RELATED APPLICATIONS

This application claims the benefit under 35 U.S.C. §119 (e) of U.S. Provisional Patent Application No. 61/163,021, filed on Mar. 24, 2009, the contents of which are relied upon and incorporated by reference.

STATEMENT REGARDING FEDERALLY SPONSORED

Research or Development

Not Applicable

REFERENCE TO A "MICROFICHE APPENDIX"

Not Applicable.

FIELD OF THE INVENTION

The present invention relates to game of beer pong wherein a ball is thrown into a cup containing beer. More particularity to those gaming tables used in beer pong.

BACKGROUND

One of the latest entertainments found in dram shops, parties, college campuses, tailgate parties, and other venues where beer is served and is otherwise consumed is the drinking game of "Beer Pong". The game generally requires a flat playing surface such as an elongated table upon which two sets of upright cups are placed. Generally, each set of cups is placed a respective end of the elongated table, with a noticeable distance between the sets of cups. As placed proximate to its respective end, the set of cups have the cups arranged in a triangle shaped format, similar to the arrangement for setting up bowling pins. The set of cups is aligned to have its triangle base of its format facing with respective end of the table while the set's triangle point faces towards to other end of the table facing the triangle point of the other set of cups' setup. Generally, speaking the length of the table allows the two sets of cups to be spaced sufficiently apart at their respective ends. Once the cup setup is completed, the cups are then each partially filled with beer and the game is ready to be played with at least two opposing players (or two opposing teams of players) and a beer pong ball (e.g., a table tennis ball).

At commence of play, each player/team is assigned to a respective end of the beer pong table, alternates taking turns of play. During a respective turn, the player/team, positioned at its assigned table end, throws the beer pong ball in an attempt to land it in one of the beer-containing-cups of other player/team. When a ball lands in a cup of a defending player/team, the defending player/team must consume all of the beer inside that cup. The game is won by the player/team who eliminates the other player/team's cups (e.g., forces the other player/team to drink all beer in its/their cups) before all of the player/team's own cups are eliminated. The losing player/team must then consume all the remaining beer in the winning player/team's cups.

Now, continuous beer consumption in such a manner, especially when several matches are played, or even tournaments are held, can sufficiently impair motor control, balance, eye-hand coordination, judgment, emotion/thought centers of the participating players to ensure that player participation in beer pong is challenging affair, yet there is still a need for a new means to make the game of beer pong more even exciting and enjoyable, thus enticing even more people to join this soon to become national past time game.

A possible solution could be a new non-static, electro-mechanical beer pong table that moves the cups in one or more directions, simultaneously or in sequence, to make beer pong game play more challenging and exciting for a player to land a beer pong ball into a beer-laden cup. Such a table could use actuators operating through an electronic controller to provide the cup movement(s) as well as provide an operator of the table with the ability to adjust cup movement(s) to control the action of the game played on such a table.

SUMMARY OF ONE EMBODIMENT OF THE INVENTION

Advantages of One or More Embodiments of the Present Invention

The various embodiments of the present invention may, but do not necessarily, achieve one or more of the following advantages:

provide a beer pong table that can adjust the degree of difficulty for a respective player to land a ball into a cup containing beer;

provide at least one movement to at least one a set of beer cups relative to a beer pong playing surface;

the ability to impart several different movements simultaneously to at least one a set of beer cups relative to a beer pong playing surface; and the ability to electronically manage the one or more movement of a set of beer pong cups relative to beer pong playing surface;

These and other advantages may be realized by reference to the remaining portions of the specification, claims, and abstract.

BRIEF DESCRIPTION OF ONE EMBODIMENT OF THE PRESENT INVENTION

One possible embodiment of the invention could an electro-mechanical beer pong gaming table comprising a playing surface with centerline axis; a plurality of movable platforms, each movable platform being located above the playing surface; each movable platform, reversibly and securely receiving a set of upright cups, each cup capable of containing beer and receiving a ball as used in the game of beer pong; a plurality of actuators that imparts one or more motions to a respective movable platform relative to the playing surface; and an electronic controller connected to a set of actuators and controlling the one or more motions movement provided by the plurality of actuators.

Another version of the invention could be a method of operating an electro-mechanical beer pong game table comprising the steps of providing electro-mechanical beer pong game table comprising a playing surface with centerline axis; a plurality of movable platforms, each movable platform supporting a set of upright cups containing beer; one or more actuators providing at least one motion to the plurality; and a controller connected to one or more actuators to control the at least one motion imparted by the one or more actuators; moving at least one movable platform in a first motion, the first motion imparted by the one or more actuators; and throwing a ball in the direction of the movable platform while the movable platform is moving.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
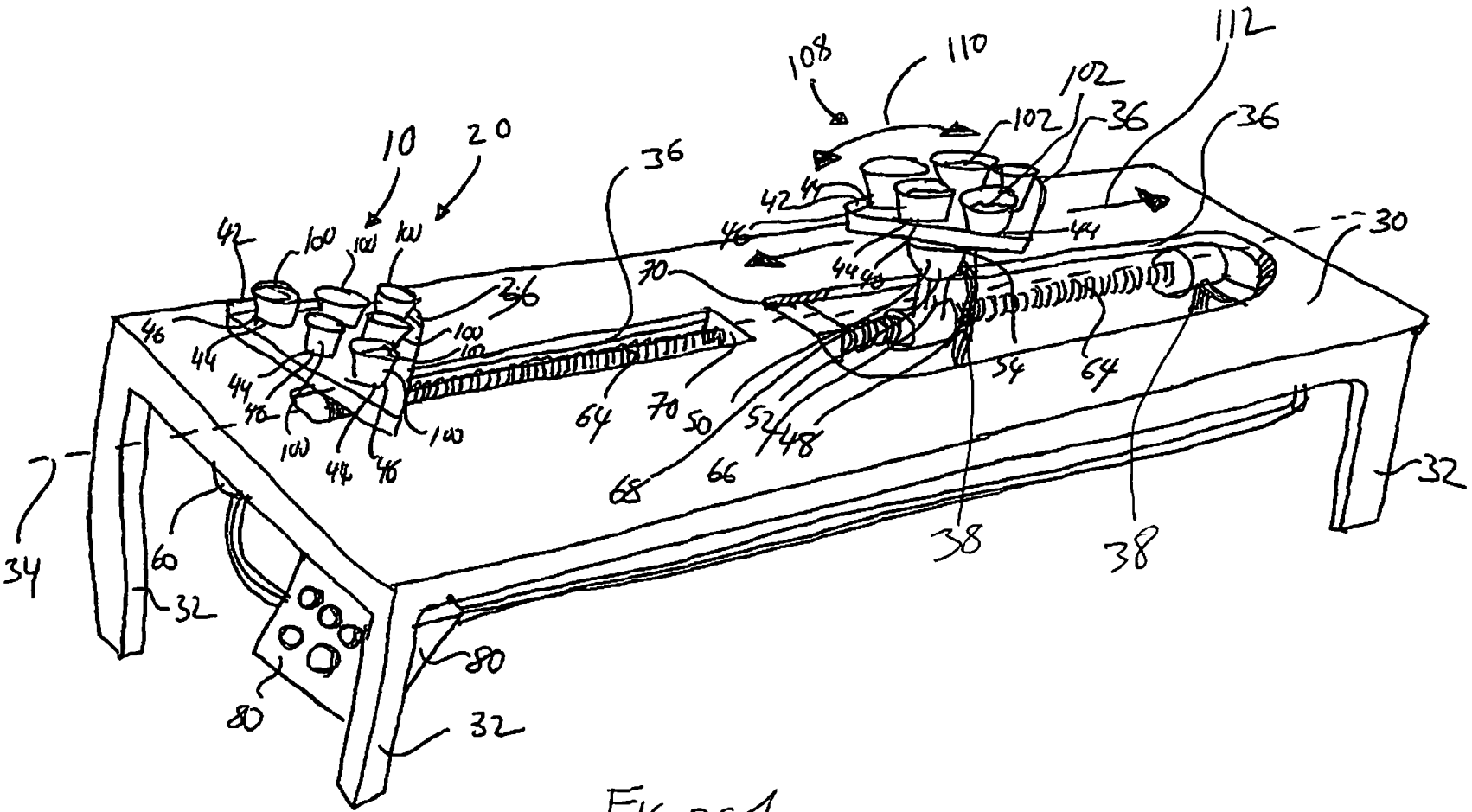
FIG. 1 is substantially an elevation view of one embodiment of the present invention.
Figure 2:
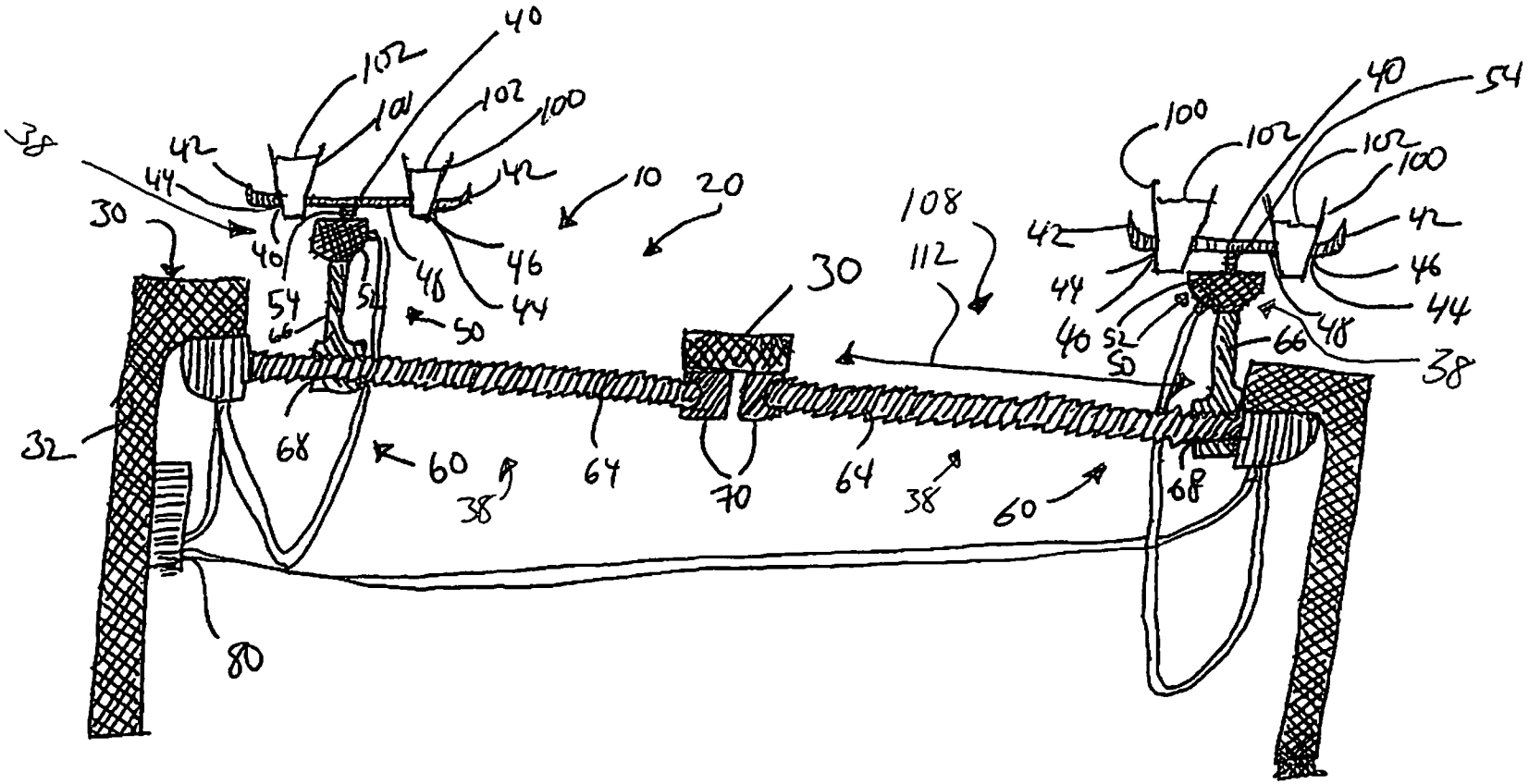
FIG. 2 is substantially a cutaway view of one embodiment of the present invention.

As substantially shown in FIG. 1, the present invention 10 could comprise of an electro-mechanical beer pong table 20 and method of use 200. The beer pong table 20 could comprise of a playing surface 30 with respective ground support 32, a plurality of movable platforms 40 (to which a respective set of beer pong cups 100 could be reversibly affixed), a plurality of actuators 38 for moving the movable platform relative to playing surface in at least one 108, and an controller 80 connected to the sets of actuators 38. In at least one embodiment, the plurality of actuators 38 could be defined as set of first actuators 50 (that generally connects to the underside 48 of a respective movable platform 40) providing a first movement 110 to the movable platform 40 and a set of second actuators 60 (that generally connects a respective first actuator 50 to the playing surface 300 to substantially provide a second and different movement 112 to the movable platform 40.

The movable platform 40 could be, in at least one embodiment, triangle-shaped with an upright raised rim 42. The movable platform 40 could accommodate five (5) to ten (10) upright cups 100 also placed upon the movable platform 40 in a triangular format (e.g., similar in format to a bowling pin array). The cups 100 could be reversibly affixed to the movable platform 40 by a variety of securing means 44. One such securing means 44 could be a series of apertures or cutouts 46 in the movable platform 40 itself, the cutouts 46 having a diameter that generally could be larger that the base of the beer cup 100 but smaller than that of the top of the beer cup 100 (the beer cup 100 generally having canted sides) to receivable hold the beer cup 100. Another embodiment of the securing means 44 could be a series of indentations (not shown) in the movable platform 40 that could snuggly and reversibly accommodate the base of the beer cup 100. Other such securing means 44 that could be employed could be hook and loop (not shown), low strength adhesive (not shown), and the like.

While the securing means 44 could generally reversibly attach the cup 100 to the movable platform 40 to be removed so that liquid (e.g., beer 102) it contains could be consumed by players in accordance with the rules of the game. At the same time, the cup 100 could generally be securely fastened to the movable platform 40 to prevent it from being knocked over during play so that beer 102 would not introduced into the actuators 50, 60, controller 80, power source (not shown) and the like.

One the underside 48 of the movable platform 40 could be located a first actuator 50 which in one embodiment could be a geared motor 52 whose axle 54 is attached to the underside 48 (e.g., at the balanced center point) of the movable platform (e.g., generally to reduce stress and stain on the attached actuator 50, and possibly provide smoother movement). In at least one embodiment, the axle 52 could also be attached to the underside 48 of the movable platform 40 that is a point of attachment that is considered to be off-center to the movable platform 40. Attachment by the first actuator 50 to the movable platform 40 could allow the first actuator 50 to impart a first or rotational motion 110 (e.g., left hand rotation, right hand rotation, or a combination of both rotations) of the movable platform 40 at controllable speeds and duration.

The playing surface 30 can be a rectangular-shaped (e.g., oblong) plate 38 whose center line axis 34 can feature for a significant portion of its length one or more channels 36 cut through it to generally connect the topside of the plate with the underside or bottom of the plate. In at least one embodiment, a ground support 32, such as a set of legs, can be attached to the underside of the plate 38 so as to support the plate 38 up and away from the ground in a level and horizontal orientation. In at least embodiment, the ground support 32 could be a set of pads or the like (not shown) that lift the plate 38 off from the ground or a supporting table (not shown) so that the placement of the plate 38 will allow and table components attached to the underside to be clear of any interference imposed by the supporting table/ground upon which the playing surface 30 has been placed. The length of the beer pong table 20 should be sufficient to support two movable platforms 40 that could move over the playing surface along the length of the channel(s) 36. The construction materials and dimensions of the playing surface 30 could be well-determined by one skilled in the art and familiar to generally comply with the various rules of the many variations of beer pong.

The second actuator 60 could in one embodiment comprise an electronically controlled geared motor 62 connected to a threaded gear shaft 64 and a vertical pillar 66 featuring a threaded aperture 68 proximate to its lower end through which the gear shaft is threaded. In this manner, the motor 62 is mounted on the underside of the playing surface 30 to generally dispose the threaded gear shaft 64 underneath the playing surface 30 generally in line with the channel 36 of the playing surface. The vertical pillar 66 could pass through the channel 36 to have its upper end proximate to the upper side of the playing surface 30. The upper end of the vertical pillar 66 could connect to an underside of the geared motor 52 for the movable platform's first actuator 50. The geared motor 62 by turning the threaded gear shaft 64 could move the vertical pillar 66, and hence the movable platform 40 along at least a portion of the length of the channel 36. The unconnected end of the threaded gear shaft 64 could be movably attached to a stanchion 70 located under the playing surface 30 proximate to channel 36. In this manner, a set of two second actuators 60, with each actuator 60 generally assigned to a respective half of the channel 36 (and each geared motor 62 being located at a respective end of the channel 36) could impart a second or linear motion (movement) 112 to their respective movable platforms 40 to move the movable platform 40 along length of the channel 36.

In another embodiment, the second actuator 60 could be configured to have the geared motor 62 rotate a flexible belt or continuous band (not shown) instead of turning a threaded shaft. The vertical pillar 66, attached at its lower end to the belt, could be moved along the channel 36 accordingly.

The controller 80 (e.g., electronic) could in one embodiment comprise a data processing capability (e.g., microchip and suitable programs as selected by those who are knowledgeable in the art) integrated with an operator interface and power supply (e.g., battery, external power, and the like) could be connected by wire harness(es) to the various actuators 38. The operator (not shown) could then control the movements of the movable platforms 40 that occurring during game play though the supply of power to the motors 52, 62 of the actuators 50, 60. In another embodiment, the controller 80 could simply be a set of operator managed manual switches controlled power and the polarity of the power to the actuators 38.

The controller 80 could have the capabilities to generally allow the operator to have real time control over the movements provided by the invention 10; be preprogrammed to provide the invention 10 with a set of repeated motions; be programmed to provide the invention 10 with a set of random motions; and the like. The motions, their speed, their change in direction of movement could be adapted to prevent excessive spilling of beer 102 from cups 100 on the movable platform(s) 40.

In operation, one example of the invention could have only one movable platform 40 (e.g. the first player/team's) would move at a time (e.g., under real-time control by operator or be preprogrammed). In one such instance, the movable platform 40 could move in the first motion 110 (e.g., rotate in one direction, stop, then rotate in the other direction) and move in a second motion 112 [move along back and forth at least a portion (e.g., its assigned half) of the length of the channel]. Although the invention 10 has been described in first and second motions 110, 112 that substantially describe the rotational and lateral movements of the movable platforms, the invention 10 could be implemented to encompass other motions/movements besides the first motion 110 and second motion 112.

Before the commence of a turn, the movable platforms 40 could be stationary ("parked") at their respective ends of the channel 36 with a tip of their triangle facing each inward along the channel 36 towards one another so that a base of each triangle could be parallel to a respective end of the playing surface 30. The operator (not shown) could then clean the sets of cups 100; place them on (in) their respective movable platforms 30; and fill them appropriately with beer 102. The operator could then power up the invention 10 and for those enabled embodiments, preprogram the moves of the respective moveable platforms 40.

The start of a first half of a turn could commence with an operator intervention, through use of the electronic controller, to initiate the movement of the first "defending" player/team's movable platform 40. As the first team tries to defend its first movable platform in action, the second "offensive" player/team would then try to get a ball (not shown) into one or more beer cup 100 containing cups on the first movable platform 40. During this time, the second movable platform 40 could be stationary at its respective end of the channel 36. When this turn is over, the first movable platform 40 could be reset, through operator intervention, via the controller 80, to its original position and orientation at its end of the channel 36.

During the next second half of the turn, the second movable platform 40, through operator intervention via the controller 80, could commence its rotation motion and its linear movement back and forth along its half of channel 36. The second player/team could attempt to defend it as the first player/team attempts to put a ball in its respective beer cups 100. At this time, the first movable platform 40 would stay stationary in starting orientation. During this time, the first movable platform 40 could be stationary at its respective end of the channel 36. When this turn is over, the second movable platform 40 could be reset, through operator intervention via the controller 80, to its original position and orientation at its end of the channel 36.

The turns in the game would continue as described until a winner for that specific version of beer pong being played on the invention 10 is obtained. At the end of the game, another game could be played (beer cups 100 being cleaned and refilled) or the games could be over, the invention 10 being powered down, wiped down, with beer cups 100 being cleaned and appropriately stored.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. An electro-mechanical beer pong table comprising:

(A) a playing surface with a centerline axis;

(B) a plurality of movable platforms, each movable platform being located above the playing surface to reversibly and securely receiving a set of upright cups, each cup capable of containing beer and receiving a ball as used in the game of beer pong;

(C) one or more actuators that impart at least one motion to the movable platforms relative to the playing surface; and (D) a controller connected to the one or more actuators to control the at least one motion provided by the one or more actuators.

2. The electro-mechanical beer pong table of claim 1 wherein the at least one motion is a movement of the movable platform along the centerline axis of the playing surface.

3. The electro-mechanical beer pong table of claim 1 wherein the at least one motion is a movement of the movable platform other than that of moving the movable platform along the centerline axis of the playing surface.

4. The electro-mechanical beer pong table of claim 1 wherein the at least one motion is rotation of the movable platform in respect to the playing surface.

5. The electro-mechanical beer pong table of claim 1 wherein the at least one motion further comprises a first motion of a rotating a respective movable platform relative to playing surface and a second motion of moving the respective movable platform along the centerline axis of playing surface, the both first and second motions occurring simultaneously.

6. The electro-mechanical beer pong table of claim 1 wherein the playing surface has one or more channels cut through it along its centerline axis.

7. The electro-mechanical beer pong table of claim 6 wherein at least a portion of at least one actuator extends through the channel to move the movable platform along at least a portion of the length of the channel.

8. The electro-mechanical beer pong table of claim 1 wherein at least one actuator connects to the underside of the movable platforms.

9. The electro-mechanical beer pong table of claim 1 wherein the one or more actuators further comprises of one actuator connected to another actuator to provide simultaneous multiple motions to the movable platform relative to the playing surface.

10. The electro-mechanical beer pong table of claim 1 wherein the one or more actuators further comprises a first set of actuators providing a first motion to a respective moveable platform and a second set of actuators providing a second motion to the respective movable platform, the second motion being different from the first movement.

11. The electro-mechanical beer pong table of claim 1 wherein the one or more actuators comprises of first set of actuators and a second set of actuators, where in the first set of actuators moves the second set of actuators.

12. The electro-mechanical beer pong table of claim 1 wherein the one or more actuators comprises a second actuator moving a first actuator along the centerline axis of the playing surface.

13. The electro-mechanical beer pong table of claim 1 wherein the playing surface is equipped with ground support to lift the playing surface up and away from the ground.

14. The electro-mechanical beer pong table of claim 1 wherein the movable platform is triangularly-shaped and has a securing means to reversibly affix the respective cups to the movable platform.

15. A method of operating an electro-mechanical beer pong table (A) providing electro-mechanical beer pong table comprising a playing surface with centerline axis; a plurality of movable platforms, each movable platform supporting a set of upright cups containing beer; one or more actuators providing at least one motion to the plurality; and a controller connected to one or more actuators to control the at least one motion imparted by the one or more actuators;

(B) moving at least one movable platform in a first motion, the first motion imparted by the one or more actuators; and (C) throwing a ball in the direction of the movable platform while the movable platform is moving.

16. A method of operating electro-mechanical beer pong table of claim 15 further comprising a step of moving the at least one movable platform in a second motion, the second motion imparted by the one or more actuators, the second motion being different from the first motion.

17. A method of operating electro-mechanical beer pong table of claim 16 further wherein the first motion and second motion occur simultaneously.

18. A method of operating electro-mechanical beer pong table of claim 16 wherein the first motion is rotating the movable platform relative to the playing surface.

19. A method of operating electro-mechanical beer pong table of claim 16 wherein the second motion is moving the movable platform along the centerline axis of playing surface.

20. A method of operating electro-mechanical beer pong table of claim 15 wherein moving the moveable platform further comprises the step of moving an actuator.

* * * * *